US008720706B2

(12) United States Patent
Robbins, III et al.

(10) Patent No.: US 8,720,706 B2
(45) Date of Patent: May 13, 2014

(54) DISPLAY STAND

(75) Inventors: Edward S. Robbins, III, Muscle Shoals, AL (US); Susan R. Kavanaugh, Florence, AL (US); Bailey J. Black, Florence, AL (US); Bryan F. Magee, Killen, AL (US); Ronald R. White, Florence, AL (US)

(73) Assignee: Edward S. Robbins, III, Muscle Shoals, AL (US)

( * ) Notice: Subject to any disclaimer, the term of this patent is extended or adjusted under 35 U.S.C. 154(b) by 230 days.

(21) Appl. No.: 13/288,127

(22) Filed: Nov. 3, 2011

(65) Prior Publication Data

US 2012/0199706 A1 Aug. 9, 2012

Related U.S. Application Data

(60) Provisional application No. 61/439,493, filed on Feb. 4, 2011.

(51) Int. Cl.
*A47F 5/02* (2006.01)
*A47F 5/04* (2006.01)

(52) U.S. Cl.
USPC ..... 211/163; 211/133.1; 211/195; 248/129; 248/159; 248/523

(58) Field of Classification Search
USPC ..... 248/128, 129, 158, 159, 165, 188.5, 248/219.1, 339, 519, 523, 524, 529; 211/162, 163, 197, 133.4, 107, 59.1, 211/195, 133.1, 133.2, 133.5
See application file for complete search history.

(56) References Cited

U.S. PATENT DOCUMENTS

| | | | | | |
|---|---|---|---|---|---|
| 923,705 | A | * | 6/1909 | Reyher | 211/163 |
| 1,718,881 | A | * | 6/1929 | Schander | 211/163 |
| D204,435 | S | * | 4/1966 | Hersh et al. | D6/410 |
| 3,777,895 | A | | 12/1973 | Weinstein et al. | 211/44 |
| 3,874,512 | A | * | 4/1975 | Wegley et al. | 211/163 |
| 4,060,214 | A | * | 11/1977 | Metcalf | 248/165 |
| 4,303,163 | A | * | 12/1981 | Henry | 211/133.4 |
| 4,453,640 | A | * | 6/1984 | Cillario | 211/133.4 |
| 4,534,473 | A | | 8/1985 | Post | 211/58 |
| 4,981,227 | A | | 1/1991 | Ingram | 211/204 |
| 5,462,178 | A | | 10/1995 | Wallach et al. | 211/95 |
| 5,732,833 | A | | 3/1998 | Alvarado et al. | 211/59.1 |
| 6,273,277 | B1 | | 8/2001 | Geldenhuys | 211/70 |
| 6,308,842 | B1 | | 10/2001 | Robbins, III et al. | 211/113 |
| 6,942,112 | B2 | | 9/2005 | Robbins, III | 211/113 |
| 8,020,716 | B2 | * | 9/2011 | Vitale | 211/197 |
| 8,240,488 | B2 | * | 8/2012 | Huang | 211/107 |

* cited by examiner

*Primary Examiner* — Tan Le
(74) *Attorney, Agent, or Firm* — Brinks Gilson & Lione

(57) ABSTRACT

A display stand has a base, a vertical pole having a lower end fixed to the base. The pole includes two sections having a stem projecting upward from each section. A bearing is coupled each stem of the pole. A pair of racks, each having a central tube with a bearing race fixed within a lower end contacts an outer surface of the bearings for rotation around the tube. Each rack has a generally square perimeter with rounded corners formed of wire, with a plurality of radial support members coupled between the central tube and the rounded corners. Each side of the square perimeter portion includes a pair of hooks adjacent the rounded corners to engage products to be displayed on the stand, the hooks projecting a limited distance outward below the plane of the rack square perimeter.

12 Claims, 5 Drawing Sheets

DISPLAY STAND

CROSS-REFERENCE TO RELATED APPLICATION

The present application is related to and claims all available benefit of U.S. Provisional No. 61/439,493 filed Feb. 4, 2011.

BACKGROUND

The present invention is directed to display racks for sheet goods such as desk pads, desk mats, floor mats, carpet mats and chair mats used to protect an underlying surface. In particular, the present invention relates to a rack for displaying such sheet goods in an attractive manner that is designed to ease the handling, and improve marketability of such sheet goods.

Desk pads, desk mats and chair mats for office and home use are well known. Desk pads can be applied to the top surface of a desk or counter to provide a convenient writing surface, and can include calendars, advertising, and other indicia of particular interest to the purchasing public. Desk mats and chair mats can be applied over carpeting and can have short and often relatively sharp spikes on the undersides thereof which hold the mats firmly in place on the carpeting. Such mats can be difficult to carry and/or otherwise handle safely. A purchaser of such mats is sometimes faced with gripping the mat about one or two of the edges often resulting in irritation if not injury to the hands due to the spikes projecting from the underside of the mat.

Such desk pads and desk mats are now being found increasingly in retail outlets, compounding the need for a safe and attractive display of such goods. While such pads and mats may be boxed, the boxes add cost and can be themselves unwieldy. As a result, boxes are not used to any great extent in the retail environment. Thus, with increasing retail activity, new displays are also required. Such pads and mats present display problems since, absent the use of boxes, they often do not stand alone.

U.S. Pat. No. 5,462,178 discloses a rack for displaying merchandise, especially floor mats packaged in a display envelope having a clamp hanger separable from the display envelope, the clamp hanger being hung on a projecting portion of the rack. The rack is disclosed as an upright revolving display stand of the type supported by both a base floor portion and an upright wall portion extending from the base floor portion. The rack is disclosed to include a pole having a first end and a second end. A bearing or other rotation means is secured to the base floor portion for rotatably supporting the first end of the pole. A cantilevered beam extends outwardly from the upright wall portion to support a second bearing or other rotation means supporting the second end of the pole so that the pole is rotatable about the first and second rotation means. The display stand is characterized by at least one display rack including at least one collar secured to the pole, three support arms extending radially from the collar, and a triangular frame attached to the support arms at the apexes thereof for supporting the articles of merchandise to be displayed. Rotation of one of the frames or collars causes simultaneous rotation of the pole and all frames and collars secured thereto, together with the displayed goods.

There remains a need for even better low-cost displays having enhanced signage space, with product related graphics designed to attract customers to the displayed goods that are sufficiently robust to withstand the wear caused by the stocking and selection activities of sheet goods, for example, desk pads and desk mats.

SUMMARY

One such display stand has a base, a pole fixed to the base to project vertically upward, and at least one bearing coupled to the pole at a selected distance above the base. A multi-sided rack can be coupled to each bearing for rotation about the pole, the rack including a multi-sided perimeter portion. A plurality of radial support members can be coupled between the central tube and the multi-sided perimeter portion. Each side of the multi-sided perimeter portion can include spaced hooks adapted to engage a product to be displayed on the stand.

In one embodiment of the display stand, the pole can have at least one section including a stem projecting upward from an upper end of the section, the stem having an outer surface dimensioned to fit an inner race of the bearing. The central tube of each rack can include a bearing race that can be fixed within a lower end of the central tube and dimensioned to contact an outer surface of the bearing. The multi-sided perimeter portion can be formed from an inner wire loop fixed to the plurality of radial support members, and an outer wire loop which can lie substantially in the same horizontal plane as the inner wire loop. The inner and outer wire loops can be fixed to each other by upper portions of the spaced product engaging hooks.

In a particularly preferred embodiment of the display stand, an upwardly projecting tube having a known internal diameter can be fixed to the base. A pole can be formed in two sections with a lower end of the lower section received in the tube to extend vertically upward from the tube. The two sections of the pole can each include a stem projecting upward from an upper end of each section. A bearing can be coupled to the stem of each section of the pole. A pair of racks can be provided with each rack including a central tube having an internal diameter greater than the diameter of the pole sections. A bearing race can be fixed within a lower end of the central tube of each rack and dimensioned to contact an outer surface of one of the bearings. Each rack can have a generally square perimeter portion with rounded corners, with a plurality of radial support members coupled between the central tube and the rounded corners. Each side of the square perimeter portion can include a pair of hooks adapted to engage a product to be displayed on the stand, the hooks being situated immediately adjacent the rounded corners.

One feature of the present display stand is that the outer ends of the product engaging hooks can be positioned below and inside the outer dimension of the perimeter portion of the rack. This feature has the advantage of protecting any passing consumer from un-intended engagement with the outwardly projecting hooks while still providing convenient product installation and selection. Other features of the present display stands and the corresponding advantages of those features will be come apparent from the following discussion of a preferred embodiment of the present invention, exemplifying the best mode of practicing the present invention, which is illustrated in the accompanying drawings. The components in the figures are not necessarily to scale, emphasis instead being placed upon illustrating the principles of the invention. Moreover, in the figures, like referenced numerals designate corresponding parts throughout the different views.

DESCRIPTION OF PREFERRED EMBODIMENTS

Figure 1:
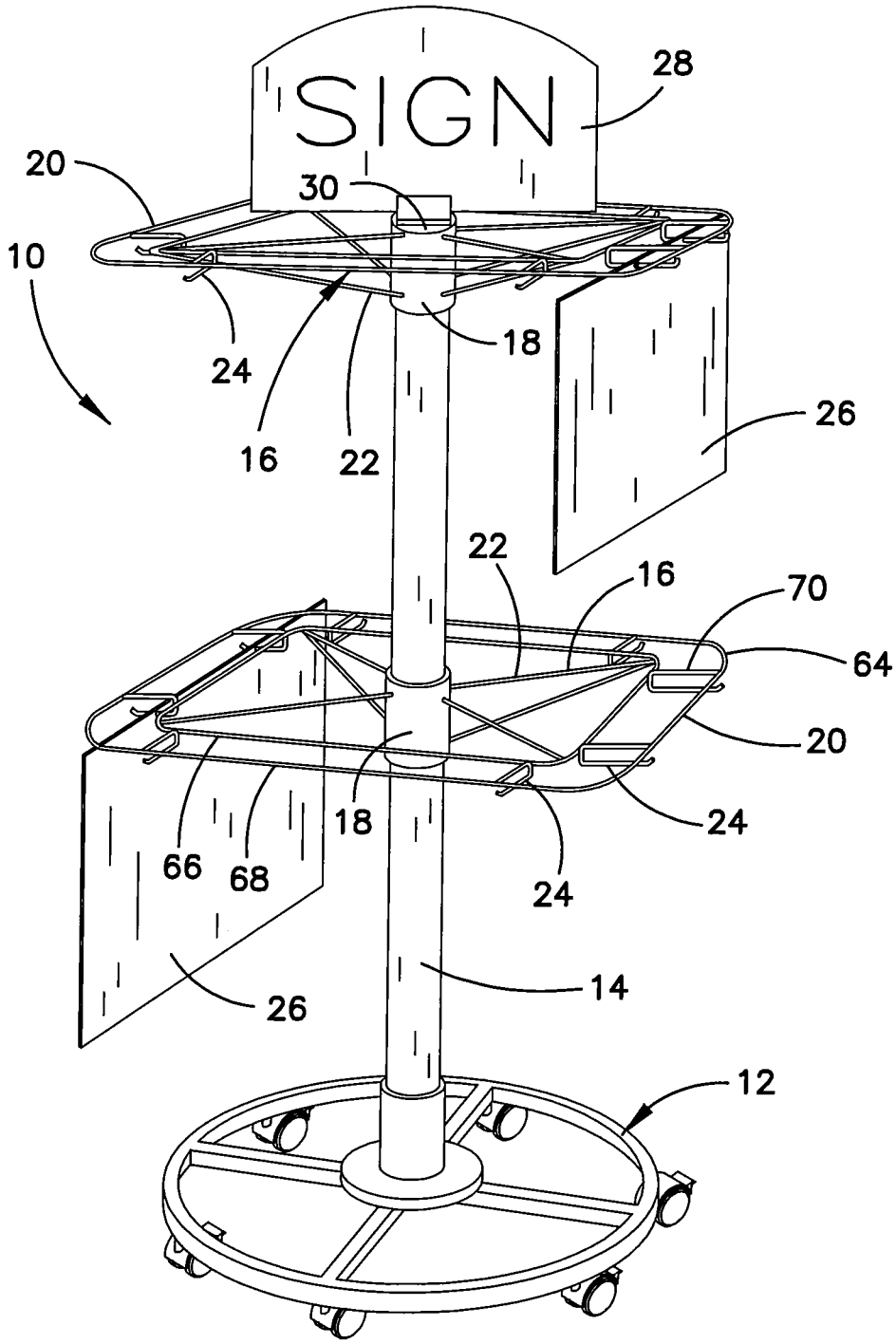
FIG. 1 is a perspective view of a preferred display stand.

FIG. 1 illustrates a display stand 10 that has a base 12, a pole 14 fixed to the base to project vertically upward from the base 12. One or more racks 16 can be coupled to the pole 14, preferably for rotation about the pole 14. Each rack 16 can include a central tube 18 and a multi-sided perimeter portion 20. The multi-sided perimeter portion 20 is illustrated to form a square, but can have other shapes such as triangular or pentagonal. A plurality of radial support members 22 can be coupled between the central tube 18 and the multi-sided perimeter portion 20. Each side of the multi-sided perimeter portion 20 can include spaced hooks 24 adapted to engage a product 26 to be displayed on the stand 10. A suitable sign 28 can be mounted to the top 30 of the display stand 10 most likely advertising the nature and brand of the product 26 on display.

Figure 2:
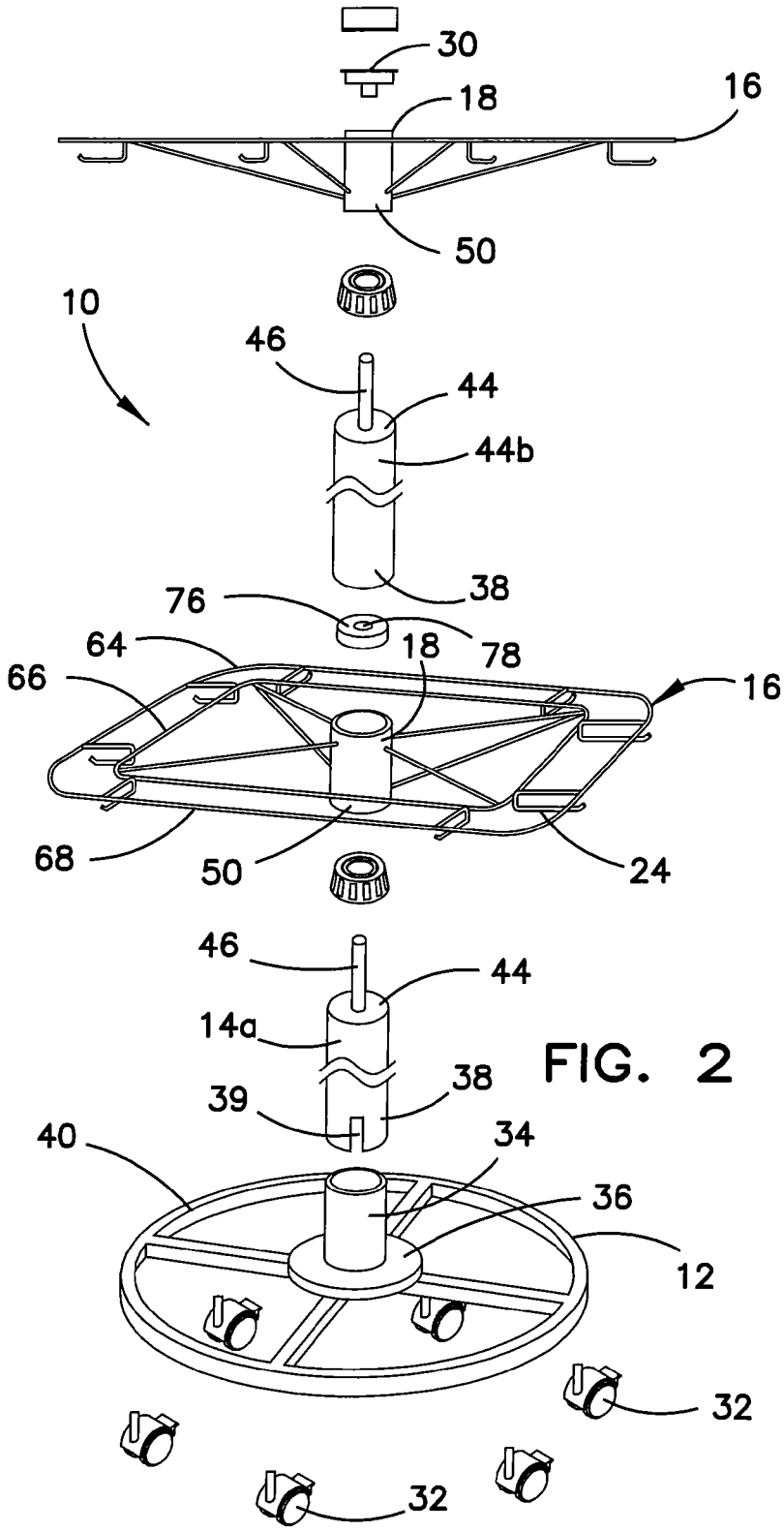
FIG. 2 is an exploded view of the display stand shown in FIG. 1.

Some further details of the display stand 10 are illustrated in the exploded view of a preferred embodiment shown in FIG. 2. The base 12 can have a plurality of casters 32 for movably supporting the base 12 relative to any underlying surface. An upwardly projecting tube 34 can be positioned on a central position 36 of the base 12. The tube 34 can have an internal diameter greater than the outside diameter of the pole 14 so that a lower end 38 of the pole 14 can be received in the tube 34. The lower end 38 of the pole 14 can include a notch 39 or other keying feature to ensure retention of the pole 14 in the tube 34. An outer perimeter portion 40 of the base 12, which can be coupled to the central position 36 by a plurality of radial arms 42, can receive the plurality of casters 32. While the outer perimeter portion 40 is illustrated to be circular, other shapes can be selected to provide the necessary stability to the display stand 10.

Figure 5:
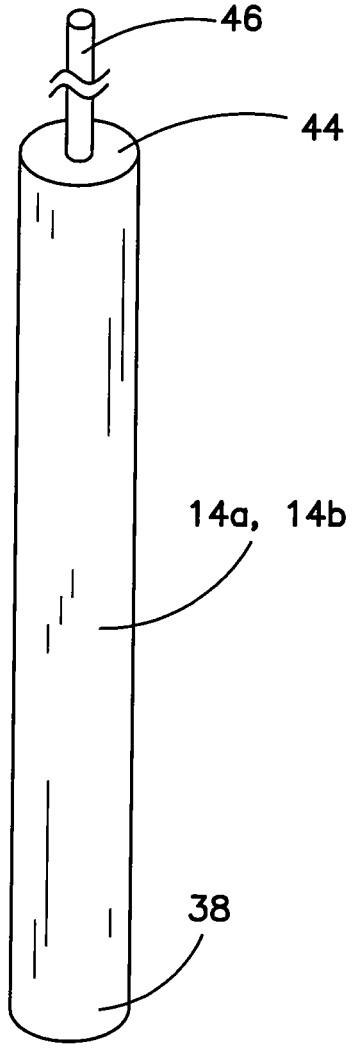
FIG. 5 is a perspective view of one pole that can be used in the preferred display stand.

The pole 14 can conveniently be segmented into any number of portions 14*a*, 14*b*, etc., so that the display stand 10 can include a plurality of racks 16. Each of the pole portions 14*a*, 14*b*, can have the form shown generally in FIGS. 2 and 5. A lower end 38 of each pole portion 14*a*, 14*b*, can be suitably dimensioned to be received in one of the upwardly projecting tubes 18, 34. An upper end 44 of each pole portion 14*a*, 14*b*, can include a centering stem 46, which can have a vertical length dimension selected to interact with other features of the display stand 10, discussed below. The pole 14, including the pole portions 14*a*, 14*b*, etc. can be tubular in construction so as to have a maximum strength with minimum weight. The pole 14, including the pole portions 14*a*, 14*b*, etc. can be cylindrical in cross-section, but other cross-sectional shapes can be adopted as well.

Figure 3:
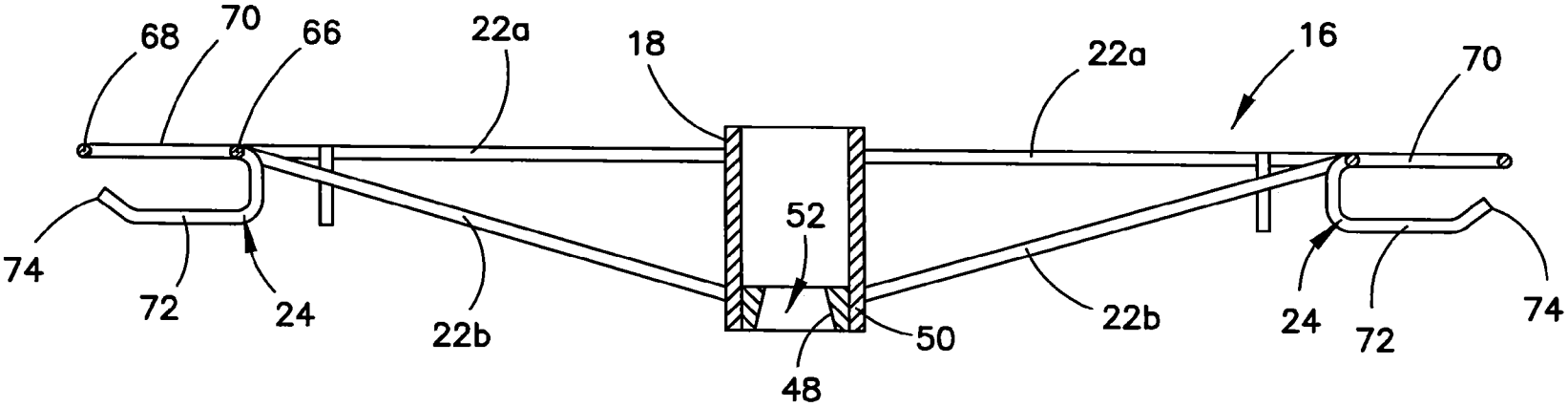
FIG. 3 is a sectional view of one rack of the display stand shown in FIG. 1.
Figure 4:
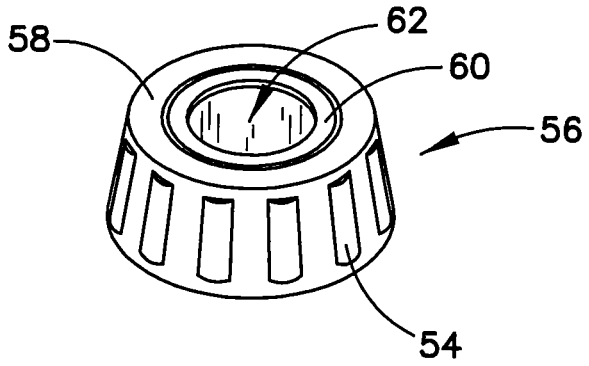
FIG. 4 is a perspective view of a roller bearing that can be used in the preferred display stand.

A lower end 50 of the central tube 18 of each of the racks 16 can include a bearing race 48 as shown in FIG. 3. An inner surface 52 of each race 48 can be dimensioned to contact an outer surface 54 of a bearing 56. The bearing 56 can have the form of a tapered roller bearing 58 as shown in FIGS. 2 and 4, but other bearing shapes, such as a ball bearing can be used. The tapered roller bearing 58 can include an inner race 60 having an opening 62 dimensioned to receive the centering stem 46 of any supporting pole portion 14. Each rack 16 can have a generally square perimeter portion 20 as shown in FIGS. 1 and 2, although other shapes are permitted.

The perimeter portion 20 of each rack 16 can have rounded corners 64, which reduce the likelihood of contact with any passing customer. The plurality of radial support members 22 can be coupled between the central tube 18 and the rounded corners 64 of the perimeter portion 20. The plurality of radial support members 22 can include a generally horizontal member 22*a* and an inclined member 22*b*. The inclined member 22*b* can be coupled to the lower end 50 of the central tube 18. The hooks 24 on each side of the perimeter portion 20 can be situated immediately adjacent the rounded corners 64 of the racks 16. The perimeter portion 20 can include an inner wire loop 66 fixed to the plurality of radial support members 22. The perimeter portion 20 can also include an outer wire loop 68 that can lie generally parallel to and substantially in the same horizontal plane as the inner wire loop 66. The inner and outer wire loops 66, 68 can be fixed to each other by upper portions 70 of the spaced hooks 24. A product engaging portion 72 of the hooks 24 can be situated below the horizontal plane defined by the inner and outer wire loops 66, 68. A terminal end 74 of the product engaging portion 72 of the hooks 24 can be advantageously positioned below and inside the outer wire loop 68 so as to inhibit any undesired contact between the terminal end 74 and a passing customer.

Figure 6:
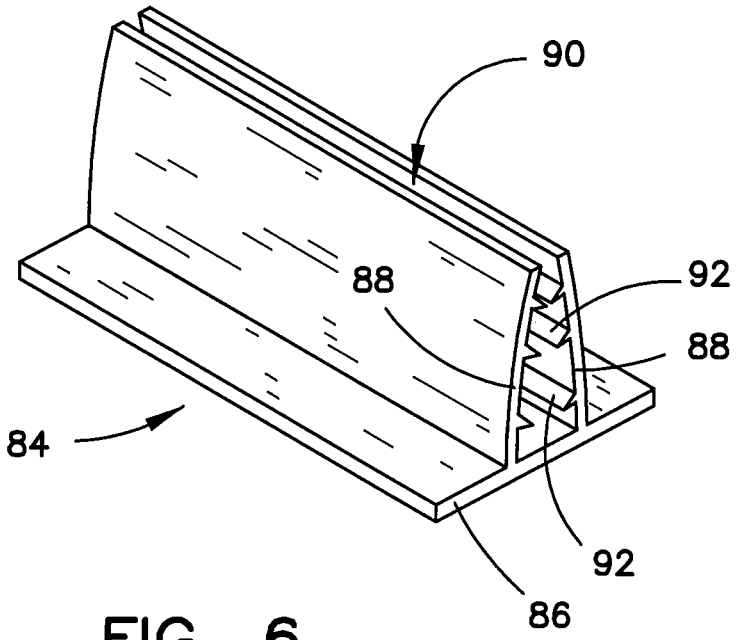
FIG. 6 is a perspective view of a sign holder that can be mounted to the top of the preferred display stand.
Figure 7:
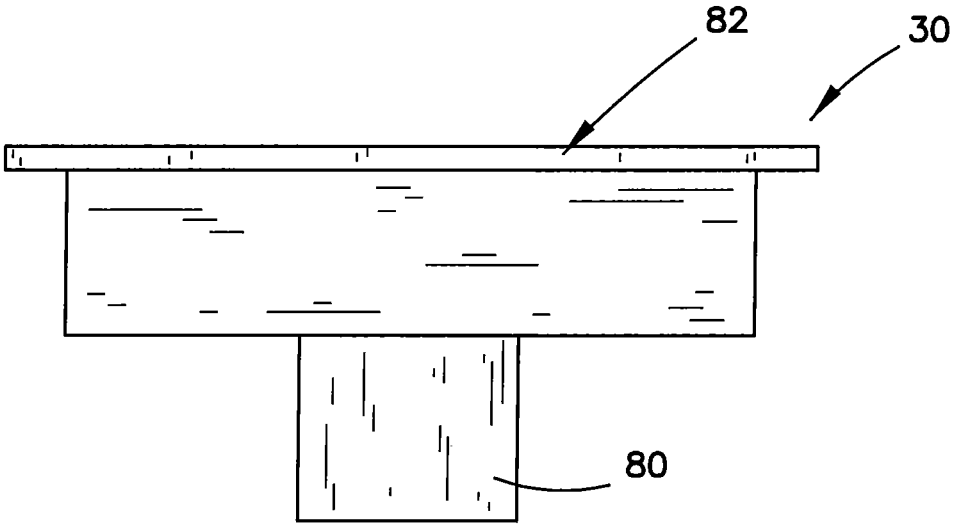
FIG. 7 is a side elevation view of a cap that can be mounted on the top of the preferred display stand

A centering washer 76, shown in FIG. 2, can be included in an upper portion of the central tube 18 of each rack 16. The centering washer 76 can include a central opening 78 dimensioned to closely receive the stem 46 of the supporting pole portion 14*a*, 14*b* to prevent any skewness of the rack 16. The display stand 10 can also include a top or cap 30 such as that shown in FIG. 7. The cap 30 can include a stem portion 80 dimensioned to be received inside the central tube 18 of the upper rack 16. The cap 30 can also include a top surface 82 dimensioned to receive a sign support member 84 such as that shown in FIG. 6. The sign support member 84 can be formed by extrusion or other means to include a base 86. A pair of confronting sign-supporting portions 88 can extend upward from the sign support base 86 to define a slot 90 including sign engaging flanges 92 designed to engage and hold the sign 28.

While these features have been disclosed in connection with the illustrated preferred embodiment, other embodiments of the invention will be apparent to those skilled in the art that come within the spirit of the invention as defined in the following claims.

The invention claimed is:

1. A display stand comprising:

a base, an upwardly projecting tube fixed to the base, a pole of known diameter having a lower end received in the tube to project vertically upward, the pole including at least two sections, each having a stem projecting upwards from an upper end of the section, at least two bearings coupled to the stem of each pole at a selected distance above the base, a multi-sided rack coupled to each bearing for rotation about the pole, the rack including a central tube having an internal diameter greater than the diameter of the pole, a bearing race fixed within a lower end of the central tube of each rack and dimensioned to contact an outer surface of one of the bearings, a four-sided perimeter portion forming a generally square rack having rounded corners, a plurality of radial support members coupled between the central tube and the four sided perimeter portion, each side of the multi-sided perimeter portion including a pair of spaced hooks adapted to engage a product to be displayed on the stand being positioned immediately adjacent to the rounded corners of the four-sided perimeter portion.

2. The display stand of claim 1, wherein the base comprises a plurality of casters movably supporting the base.

3. The display stand of claim 1, wherein the four sided perimeter portion comprises an inner wire loop fixed to the plurality of radial support members, an outer wire loop lying substantially in the same horizontal plane as the inner wire loop, and wherein the inner and outer wire loops are fixed to each other by upper portions of said spaced hooks.

4. The display stand of claim 1, further comprising a cap coupled to an upper end of the pole, the cap including an upper surface supporting a sign holder for a sign situated above the upper end of the pole.

5. A display stand comprising:

a base, an upwardly projecting tube fixed to the base having a known internal diameter, a pole having a lower end received in the tube to extend vertically upward from the tube, the pole including at least two sections having a stem projecting upward from an upper end of the section, bearings coupled to the stem of each section of the pole, at least one multi-sided rack including a central tube having an internal diameter greater than the diameter of the pole, a bearing race fixed within a lower end of the central tube of each rack and dimensioned to contact an outer surface of one of the bearings, each multi-sided rack having a multi-sided perimeter portion including four sides forming a generally square rack having rounded corners, a plurality of radial support members coupled between the central tube and the multi-sided perimeter portion, and each side of the multi-sided perimeter portion including a pair of spaced hooks adapted to engage a product to be displayed on the stand and being positioned immediately adjacent to the rounded corners.

6. The display stand of claim 5, wherein each multi-sided perimeter portion comprises an inner wire loop having corners fixed to the plurality of radial support members, an outer wire loop generally parallel to the inner wire loop and lying substantially in the same horizontal plane as the inner wire loop, and wherein the inner and outer wire loops are fixed to each other by upper portions of said spaced hooks.

7. The display stand of claim 5, wherein the base comprises an outer perimeter portion, and a plurality of casters coupled to the outer perimeter portion of the base for movably supporting the base.

8. The display stand of claim 5, further comprising a cap coupled to an upper end of the pole, the cap including an upper surface supporting a sign holder for a sign situated above the upper end of the pole, the sign holder including a base fixed to the cap upper surface and a pair of spaced confronting sides including internal ridges for gripping the sign received between the two confronting sides.

9. A display stand comprising:

a base, an upwardly projecting tube fixed to the base having a known internal diameter, a pole having a lower end received in the tube to extend vertically upward from the tube, the pole including two sections having a stem projecting upward from an upper end of each section, a bearing coupled to the stem of each section of the pole, a pair of racks, each rack including a central tube having an internal diameter greater than the diameter of the pole sections, a bearing race fixed within a lower end of the central tube of each rack and dimensioned to contact an outer surface of one of the bearings, a generally square perimeter portion with four rounded corners, a plurality of radial support members coupled between the central tube and the rounded corners of the perimeter portion, and each side of the square perimeter portion including a pair of hooks adapted to engage a product to be displayed on the stand, the hooks being situated immediately adjacent the rounded corners.

10. The display stand of claim 9, wherein each perimeter portion comprises an inner wire loop having corners fixed to the plurality of radial support members, an outer wire loop generally parallel to the inner wire loop and lying substantially in the same horizontal plane as the inner wire loop, and wherein the inner and outer wire loops are fixed to each other by upper portions of said spaced hooks, and said product engaging portion of the hooks is situated below the said horizontal plane and extends outward from a position below the inner wire loop to a terminal end located inside the outer wire loop.

11. The display stand of claim 10, wherein the base comprises an outer circular perimeter portion, and a plurality of casters coupled at equally spaced separations around the outer perimeter portion of the base for movably supporting the base.

12. The display stand of claim 11, further comprising a cap coupled to an upper end of the pole, the cap including an upper surface supporting a sign holder for a sign situated above the upper end of the pole, the sign holder including a base fixed to the cap upper surface and a pair of spaced confronting sides including internal ridges for gripping the sign received between the two confronting sides.

* * * * *